US005857488A

United States Patent [19]

Kobelt

[11] Patent Number: 5,857,488

[45] Date of Patent: Jan. 12, 1999

[54] MULTI-MODE SELECTOR VALVE ASSEMBLY FOR MARINE STEERING SYSTEM

[76] Inventor: Jacob Kobelt, 1654 Ocean Park Road, Surrey, British Columbia, Canada, V4A 4V5

[21] Appl. No.: 883,449

[22] Filed: Jun. 26, 1997

[51] Int. Cl.[6] ..... F15B 11/17

[52] U.S. Cl. ..... 137/596; 60/385; 60/386; 114/150; 137/864; 137/868

[58] Field of Search ..... 60/385, 386; 114/150; 137/596, 864, 868

[56] References Cited

U.S. PATENT DOCUMENTS 5,289,756 3/1994 Kobelt ..... 60/385

*Primary Examiner*—Gerald A. Michalsky

[57] ABSTRACT

A hydraulic valve apparatus is for controlling pressurized fluid flow to at least a pair of coupled hydraulic actuators in response to operator signals. The valve apparatus comprises a main body having main ports communicating selectively with a fluid supply and fluid return, body ports to communicate with the actuators, and a scavenge port to communicate with the return. Each actuator communicates with two control valves and one scavenge valve on the valve body to control fluid flow relative to the actuators. Control devices cooperate with the control and scavenge valves of each actuator so as to actuate the respective valves simultaneously. The control devices maintain the two related control valves in the same phase with respect to each other, but in an opposite phase to the respective scavenge valve. In an emergency, an appropriate valve actuating device switches the appropriate control valves from a normally open to a normally closed position, while simultaneously switching the related scavenge valve from a normally closed to a normally open position. This permits an operating cylinder to passively displace an inoperative cylinder to enable operation of the apparatus with one actuator only.

20 Claims, 9 Drawing Sheets

MULTI-MODE SELECTOR VALVE ASSEMBLY FOR MARINE STEERING SYSTEM

BACKGROUND OF THE INVENTION

The invention relates to a hydraulic selector valve assembly for marine steering systems, particularly steering systems for relatively large marine vessels which utilize at least two power cylinders actuating a single rudder or coupled twin rudders.

Marine safety certifying authorities such as Lloyds of London or the American Bureau of Shipping require that a steering system normally utilizing two power cylinders for controlling single or twin rudders must be able to operate in a single cylinder steering mode, should there be a failure of the remaining cylinder or circuits associated with that cylinder. Thus, for safety reasons, the steering system must be operable with one cylinder active, and the other cylinder inactive. Usually, the inactive or passive cylinder can be made to "float" as it is driven by the active or operable cylinder which enables functioning of the steering gear with one cylinder only. However, because most large marine steering systems use unbalanced cylinders, that is the piston rod associated with the cylinder does not pass through both ends of the cylinder, a different volume of fluid is displaced when the cylinder extends or retracts, i.e there is a fluid volume differential on opposite sides of the piston. The volume differential presents problems in an emergency when it is necessary to isolate the inactive cylinder in a closed circuit because when the active cylinder drives the inactive cylinder the volume differential of the inactive cylinder causes a hydraulic lock.

To enable operation of the steering system using one cylinder, six or eight manually actuated emergency valves are provided in appropriate hydraulic lines to enable an engineer to direct fluid in such a way that the active cylinder can steer the vessel, and the inactive cylinder can follow movement of the rudder without undue restriction. To enable the steering to function using the remaining cylinder, the engineer must manipulate the correct emergency valves in the correct sequence to direct fluid appropriately. However, because failure usually happens in extreme weather conditions or exceptional situations, which occur only rarely, the engineer is usually unfamiliar with the correct manipulation of the emergency valves, and thus mistakes often occur so that the emergency single cylinder steering mode is not always easily and quickly available.

SUMMARY OF THE INVENTION

The invention reduces the difficulties and disadvantages of the prior art by providing a multi-mode selector valve assembly for marine steering systems which simplifies shifting from the normal steering mode to the emergency mode should failure occur in one of the steering actuators, valves or hydraulic circuits associated with a twin cylinder steering apparatus as found on relatively large and/or multi-rudder marine vessels. The invention provides a compact valve assembly which has two manually-actuated control handles, only one of which is actuated during an emergency. Thus, an engineer is not required to manipulate a complex valve structure in the correct sequence as required in the prior art.

A hydraulic valve apparatus according to the invention is for controlling pressurized fluid flow from at least a first fluid pump for distribution to left hand and right hydraulic actuators in response to signals from an operator, each actuator having first and second actuator ports. The valve apparatus comprises a main valve body, left hand and right hand scavenge valves, first and second left hand control valves, first and second right hand control valves, and right hand and left hand control devices. The main valve body has first and second main ports communicating selectively as required with a fluid supply or a fluid return, and a main scavenge port to return fluid to a sump. The main valve body also has first and second left hand body ports to communicate with the first and second actuator ports of the left hand hydraulic actuator respectively. The main valve body also has first and second right hand body ports to communicate with the first and second actuator ports of the right hand actuator respectively. The left hand and right hand scavenge valves communicate with the main scavenge port. The left hand scavenge valve also communicates with the first and second left hand body ports, and the right hand scavenge valve also communicates with the first and second right hand body ports. The first and second left hand control valves communicate with the fluid supply and fluid return selectively as required, and also with the left hand body ports. The first and second right hand control valves communicate with the fluid supply and fluid return selectively as required, and also with the right hand body ports. The left hand control device cooperates with the first and second left hand control valve and a left hand scavenge valve to actuate all said left hand valves simultaneously. The right hand control device cooperates with the first and second right hand control valves and the right hand scavenge valve to actuate all said right hand valves simultaneously.

In addition, the left hand and right hand control devices are operable independently of each other, and the left hand control device maintaining the first and second left hand control valves in identical modes, and the right hand control device maintaining the first and second right hand control valves in identical modes.

In addition, the left hand control device maintains the left hand scavenge valve in a mode opposite to the first and second left hand control valves, and the right hand control device maintains the right hand scavenge valve in a mode opposite to the first and second right hand control valves.

The apparatus further comprises a primary directional valve selectively communicating with the first and second main port as required. The directional valve is adapted to interchange connections between the pump and the sump and the first and second main ports. Preferably, the apparatus further comprises a secondary directional valve selectively communicating with the first and second main port as required similarly to and in parallel with the primary directional valve. The directional valves are adapted to be actuated separately or concurrently.

In addition, the left hand scavenge valve is connected in parallel with the first and second left hand control valves, and the right hand scavenge valves connected parallel with the first and second right hand control valve.

The main valve body comprises of a plurality of manifold units which includes at least one manifold plate having a plate surface with at least one surface groove therein. The surface groove has a gasket groove extending therearound and the resilient gasket is received within the groove. The valve body further includes a separator plate having a surface held against the plate surface of the manifold plate so that the gasket is compressed within the gasket groove so as to seal against the surface of the separator plate to define a conduit between the manifold plate and the separator plate.

A detailed disclosure following, relating to drawings, describes a preferred embodiment of the invention which is capable of expression in structural other than that particularly described and demonstrated.

DESCRIPTION OF THE DRAWINGS

In the following figures, some fluid connections and mechanical connections may be omitted for clarity.

DETAILED DESCRIPTION

FIG. 1

Figure 1:
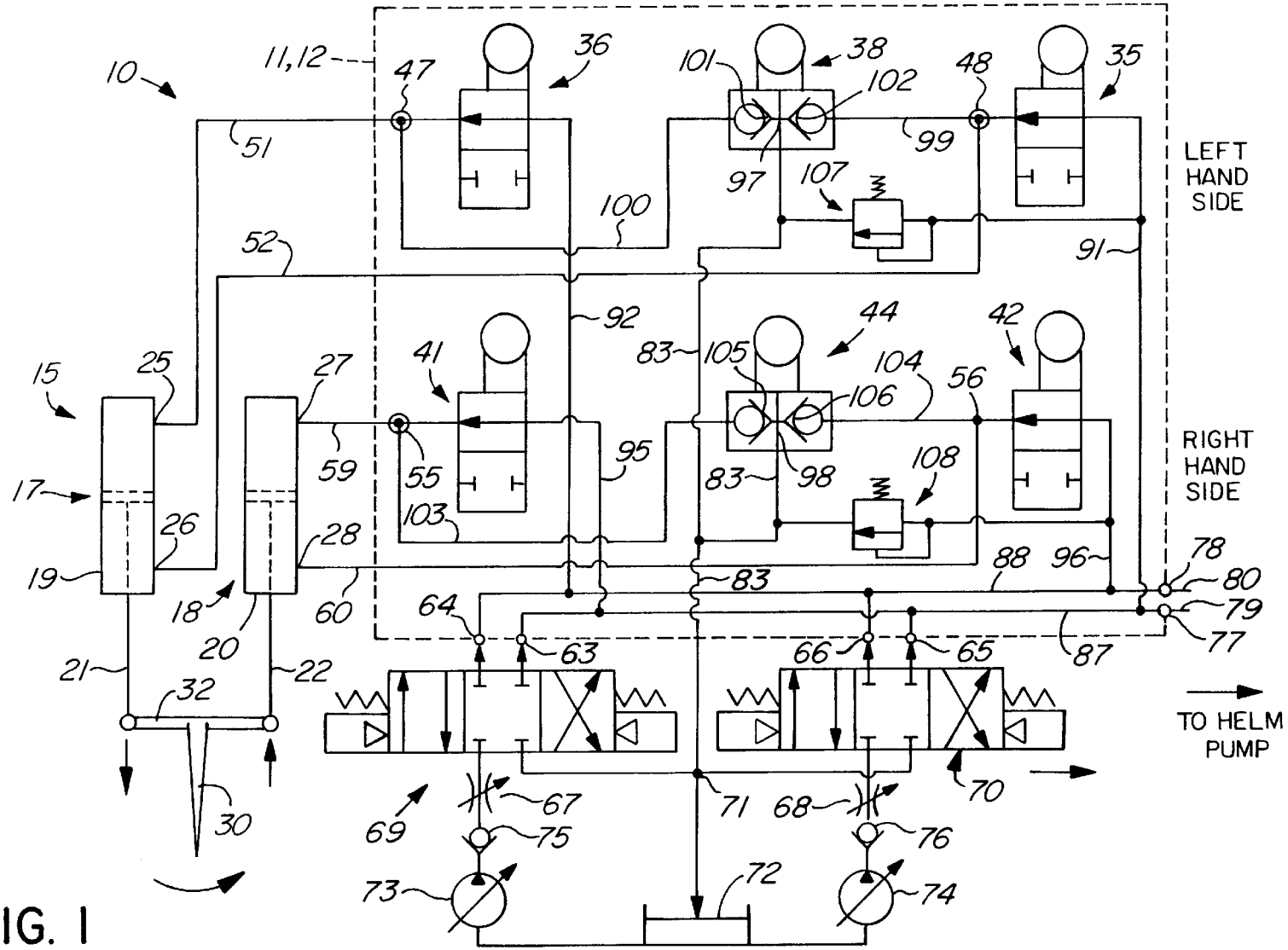
FIG. 1 is a simplified hydraulic schematic showing main hydraulic components and conduits of a valve apparatus according to the invention, some associated mechanical structure also being shown schematically and simplified.

A hydraulic circuit 10 according to the invention includes a valve apparatus 11, most of which is contained within or connected directly to a main valve body 12 which is shown schematically in broken outline extending around most of the components of the apparatus. The valve apparatus 11 controls a conventional twin cylinder steering assembly 15 which comprises left hand and right hand hydraulic actuators, i.e. hydraulic cylinders 17 and 18 having cylinder bodies 19 and 20 respectively with respective piston rods 21 and 22 extending therefrom. The terms "left" and "right", "upper" and "lower", "first" and "second" etc., as used throughout the disclosure and claims are for identification purposes only, and do not necessarily specify or limit the location, relative position or importance of any item so identified.

The left hand cylinder body 19 has first and second actuator ports 25 and 26 located at opposite ends thereof, and the right hand cylinder body 20 is generally similar and has first and second actuator ports 27 and 28 located at opposite ends thereof. A rudder 30 is mounted on a rudder coupling 32 which cooperates with the piston rods 21 and 22 to couple the actuators together to operate in unison to rotate the rudder for steering purposes as is well known. Thus, each cylinder body is hingedly mounted in a conventional manner to follow rotation of the rudder as required, and has a rod end through which the respective piston rod extends, an opposite or head end being sealed. Thus, the cylinders are "unbalanced" and there is a fluid volume differential between a rod chamber and a head chamber on opposite sides of the piston, resulting in unequal volumes of fluid displaced on opposite sides of the piston.

The valve apparatus 11 comprises first and second left hand control valves 35 and 36, and a left hand scavenge valve 38, the valves 35, 36 and 38 being mounted on the body 12 as will be described, and located to be spaced apart along one side of the apparatus as shown. The apparatus 11 further includes first and second right hand control valves 41 and 42, and a right hand scavenge valve 44, the valves 41, 42 and 44 being similarly mounted on the body and located on a side of the apparatus generally opposite to the valves 35, 36 and 38. The control valves 35, 36, 41 and 42 are similar 2-way, normally-open valves which are shifted mechanically and are internally connected to the valve body as will be described with reference to FIGS. 4 through 11. The scavenge valves 38 and 44 are similar non-conventional 2-way, normally-closed valves which are shifted mechanically and communicate internally with the valve body, as will be described with reference to FIGS. 4 through 11.

The body 12 has internal conduits and ports which communicate with the valves as will be described, and has external body ports which communicate through hydraulic lines with the hydraulic cylinders 17 and 18, to supply pressurized fluid to, or receive fluid scavenged therefrom following normal practice. Because FIG. 1 is a schematic and the apparatus 12 is a three-dimensional array of valves and conduits, location of external ports shown in FIG. 1 does not represent relative position of the ports with respect to the body as will be described with respect to later drawing figures. The external ports are shown on conduits for convenient representations in diagrammatic form. Thus, the body 12 has first and second left hand body ports 47 and 48 to communicate with the first and second ports 25 and 26 respectively of the left hand cylinder 17 through first and second left hand actuator conduits 51 and 52 respectively. Similarly, the body 12 has first and second right hand body ports 55 and 56 which communicate with the first and second ports 27 and 28 of the right hand cylinder 18 through first and second right hand actuator conduits 59 and 60. It can be seen that the first and second left hand control valves 35 and 36 communicate with the second and first left hand body ports 48 and 47 respectively. Also, the first and second right hand control valves 41 and 42 communicate with the first and second right hand body ports 55 and 56 respectively.

The body 12 has additional external ports, namely first and second primary main ports 63 and 64, and first and second secondary main ports 65 and 66, which communicate with generally similar primary and secondary directional steering valves 69 and 70 respectively. The directional steering valves 69 and 70 have inputs connected to primary and secondary variable flow controls 67 and 68 which receive pressurized fluid from primary and secondary steering pumps 73 and 74 respectively. The body also has a main scavenge port 71 which communicates with a sump 72 to return low pressure fluid. The steering pumps communicate with the sump 72 to receive fluid therefrom and supply variable flows of fluid through respective primary and secondary check valves 75 and 76. Preferably, the steering pumps 73 and 74 and/or the steering valves 69 and 70 are similar, but the flow controls 67 and 68 are adjusted to give different flows therethrough which results in the pairs of main ports 63 and 64, and 65 and 66 carrying different volume flow rates. The pumps 73 and 74 are connected in parallel to each other and can be actuated separately or concurrently. Operation of the pumps 73 and 74 together or separately provides different volume flow rates to generate different speeds of response, i.e. steering movements, and are similarly connected to provide redundancy so that, should one steering pump or valve fail, the other is available for use in an emergency. Both directional valves function similarly, and are adapted to interchange connections between the pump and sump and first and second main ports to provide steering to the left and right selectively, as required. The steering valves 69 and 70 are conventional 4-way, 3-position valves with a closed centre position and are solenoid actuated by a helm, not shown, on the bridge. Clearly alternate means of actuating the steering valves can be substituted.

The body 12 further includes additional external ports, namely first and second emergency ports 77 and 78 which are connected to first and second helm pump conduits 79 and 80 respectively. The pump conduits lead to a manually actuated steering helm pump, not shown, which supplies manually pressurized fluid as required for emergency use only should both of the steering pumps 73 and 74 fail, or both of the valves 69 and 70 fail or become inoperative for other reasons. The helm pump can be a conventional swash-plate pump which is rotated manually by an emergency helm in an appropriate direction to manually pressurize fluid to effect steering should the normal power-pressurized fluid supply fail. The helm pump has internal check valves to permit normal powered operation, and to prevent pressure loss or undesirable fluid displacement as is well known.

The actual location of the internal conduits interconnecting the valves in the three-dimensional array will be described in greater detail with reference to FIGS. 2 through 11. The main conduits interconnect the various valves and ports as follows. A bifurcated main scavenge conduit 83 extends between the right hand and left hand scavenge valves 38 and 44 and interconnects with the main scavenge port 71 to return fluid to the sump 72. The main valve body further includes first and second main conduits 87 and 88 which communicate with the first and second primary main ports 63 and 64 respectively, the first and second secondary main ports 65 and 66 respectively, and the first and second emergency ports 77 and 78 respectively, as well as providing connections to the control valves 35, 36, 41 and 42 as follows.

The body 12 includes first and second left hand control conduits 91 and 92 which communicate the first and second left hand control valves 35 and 36 with the first and second main ports 63 and 64 (and 65 and 66) through the main conduits 87 and 88 respectively as shown and thus communicate selectively with the fluid supply and return.

Similarly, first and second right hand control conduits 95 and 96 communicate the first and second right hand control valves 41 and 42 with the first and second main ports 63 and 64 (and 65 and 66) through the conduits 87 and 88 respectively as shown.

The body 12 also has first and second left hand scavenge conduits 99 and 100 which communicate the first and second left hand body ports 47 and 48 respectively with the left hand scavenge valve 38. Similarly, first and second right hand scavenge conduits 103 and 104 communicate the first and second right hand body ports 55 and 56 with the right hand scavenge valve 44. It can be seen that the left hand scavenge valve 38 is connected in parallel with the first and second left hand control valves 35 and 36 respectively, and the right hand scavenge valve 44 is connected in parallel with the first and second right hand control valves 41 and 42 respectively.

Figure 4:
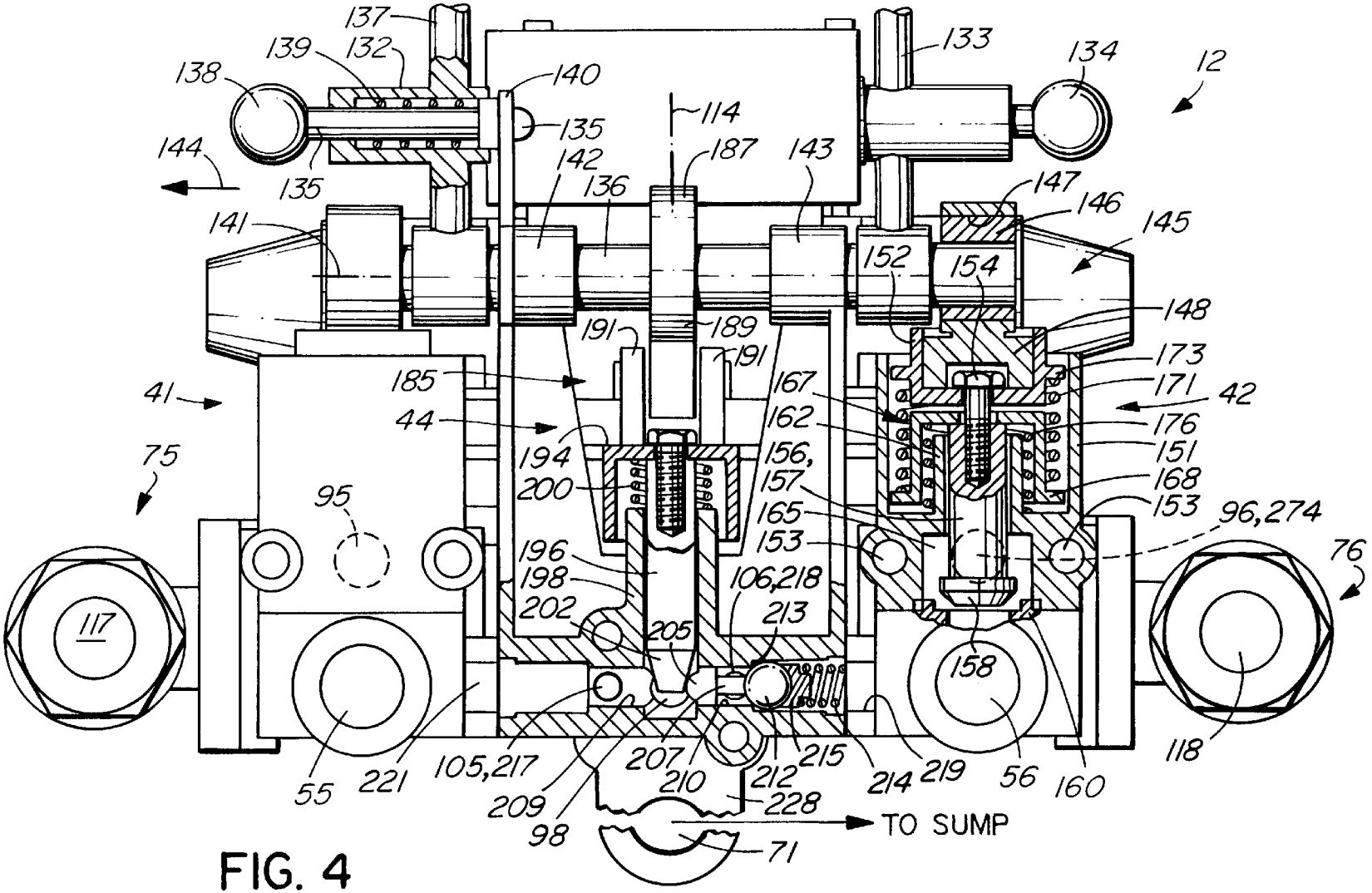
FIG. 4 is a simplified front view of the valve apparatus some portions being sectioned to show internal structure relating to a control valve and a scavenge valve as seen generally on Line 4—4 of FIG. 2, one directional steering valve being removed for clarity.

The scavenge valves 38 and 44 are of a non-conventional design which is shown schematically in FIG. 1, and the valve 44 is disclosed in more detail in FIG. 4. The left hand scavenge valve 38 has first and second scavenge ports 101 and 102 communicating through the first and second body ports 47 and 48 respectively with the first and second actuator ports 25 and 26 respectively of the left hand actuator. The valve 38 also has a main scavenge port 97 communicating with the main scavenge conduit 83 of the valve body. Similarly, the right hand scavenge valve 44 has first and second scavenge ports 105 and 106 communicating through the first and second body ports 55 and 56 with the first and second actuator ports 27 and 28 respectively of the right hand actuator. Similarly, the main scavenge port 98 also communicates with the main scavenge conduit 83 of the body.

First and second spring-closed pressure relief valves and associated conduits 107 and 108 are connected in parallel with the left hand and right hand scavenge conduits 99 and 104 respectively, and open only in exceptional circumstances. The valve and conduit 107 extend between the control conduit 91 and the main scavenge conduit 83, and the valve opens in response to an excess pressure in the conduit 91 which reflects pressure in the conduit 52. Similarly, the valve and conduit 108 extend between the control conduit 96 and the main scavenge conduit 83 and the valve opens in response to excess pressure in the conduit 96 which reflects pressure in the conduit 60. The excess pressure which opens the relief valves functions as a pilot pressure and can arise when the rudder unintentionally contacts an obstruction and generates an excessive pressure within fluid in the cylinders 17 or 18, and thus the obstruction takes over control of movement of the rudder. The relief valves 107 and 108 are thus safety valves to essentially prevent or at least reduce damage to the steering system.

Figure 2:
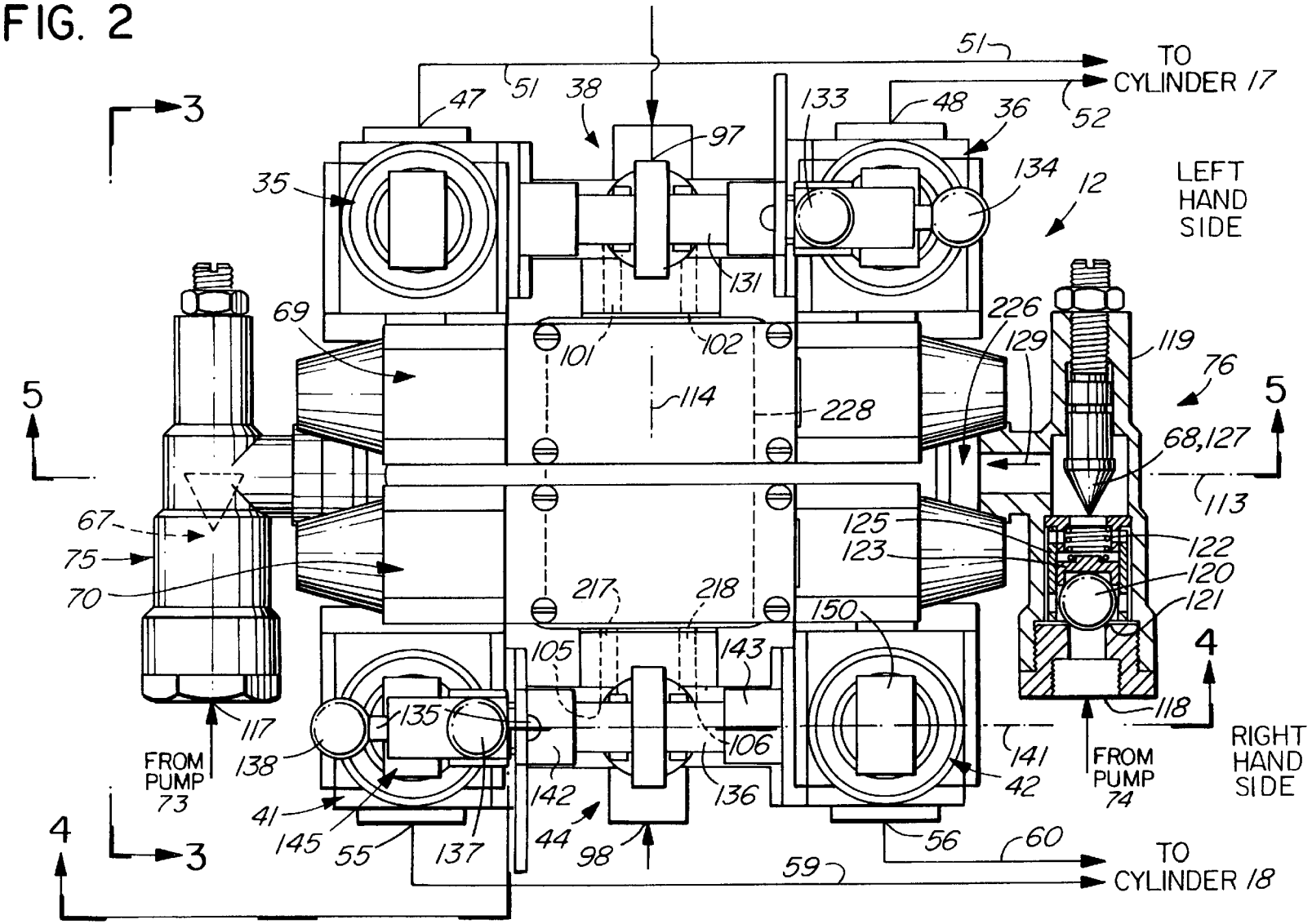
FIG. 2 is a simplified fragmented top view of the valve apparatus according to the invention, a steering check valve being sectioned to show internal detail.

FIGS. 2. 3 and 4

Figure 3:
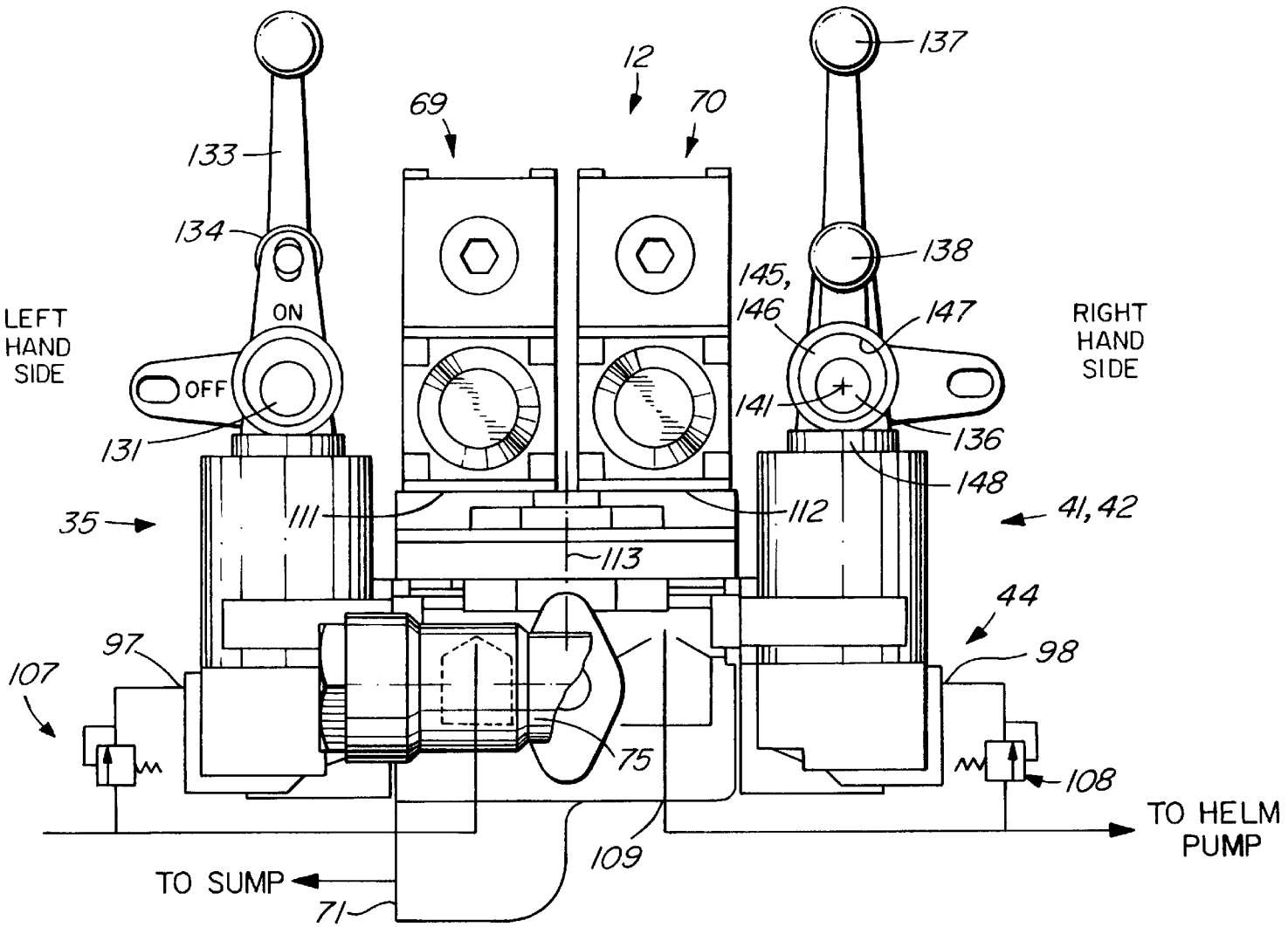
FIG. 3 is a simplified fragmented side view of the valve apparatus as seen from Line 3—3 of FIG. 2, pressure relief valves and conduits being shown schematically, and a directional steering valve being shown fragmented.

Referring to FIGS. 2 and 3, the main valve body 12 comprises an assembly of fluid manifold components which are of a modular design for ease of assembly, and for manufacturing by die casting, thus reducing machining. The manifold components provide mechanical mounting connections and fluid communication for the four control valves 35, 36, 41 and 42 and the two scavenge valves 38 and 44. In addition, the body provides mechanical and fluid connections for the two directional steering valves 69 and 70, the primary and secondary steering check valves 75 and 76, and other miscellaneous structure. In addition, the body provides easily accessible connections adjacent to the external body ports 47, 48, 55 and 56 leading to the cylinders 17 and 18, and the first and second emergency ports 77 and 78 leading to the emergency helm pump, not shown. In FIG. 2, the main scavenge ports 97 and 98 of the scavenge valves 38 and 44 respectively are shown schematically connected to the conduits 52 and 60 through the pressure relief valves 107 and 108 respectively, which of course only open when the conduits 52 and 60 are exposed to excess pressure. In FIG.

3, the pressure relief valve 108 is shown connected to a discharge port 109 of one of the modular components of the apparatus, and the main scavenge port 98 of the scavenge valve 44, whereas in FIG. 2 the valves 107 and 108 and associated conduits are omitted for clarity. Details of the fluid manifold components are to be described with a reference to FIGS. 5 through 11.

The valve apparatus 11 is generally symmetrical about mutually perpendicular, longitudinal and transverse axes 113 and 114 respectively. The directional steering valves 69 and 70 are located adjacent the left and right hand valves respectively and disposed parallel to and on opposite sides of the axis 113 and are not described in detail as they are conventional 3-position 4-way spool valves. The four ports of each valve 69 and 70 are disposed on generally flat mounting faces 111 and 112 respectively, and positioned to communicate with complementary ports in fluid manifold components to be described with reference to FIGS. 6 through 11. The primary and secondary steering check valves 75 and 76 are located at opposite ends of the main valve body, are essentially identical to each other, and receive and pass fluid under pressure at check valve inputs 117 and 118 respectively from the steering pumps 73 and 74 (FIG. 1).

The valve 76 has a steering valve body 119 provided with passages to receive valve components which control flow of fluid as follows. The valve 76 has a ball 120 held against a valve seat 121 by a valve spring 122 which engages a receiver 123 disposed between the spring and the ball. The spring and receiver are located within a sleeve 125 provided with ports and passages to pass fluid when the ball is displaced from the seat 121, due to input pressure overcoming force from the spring. A generally conical metering needle 127 is adjustable longitudinally of the sleeve to meter volume of fluid flow there through as required. Fluid metered by the needle passes into the valve body per arrow 129 for later distribution as will be described with reference to FIGS. 5–11. The check valve 75 is generally similar to the valve 76 and when operating discharges fluid into a side of the valve body opposite to the valve 76.

The first and second left hand control valves 35 and 36 are positioned on opposite sides of the left hand scavenge valve 38 and adjacent an outer side of the directional steering valve 69. A left hand valve actuating shaft 131 extends along and above the three valves 35, 38 and 36, and has a left hand valve actuating handle 133 and a shaft locking handle 134. Similarly, the right hand control valve 41 and 42 are positioned on opposite sides of the right hand scavenge valve 44, adjacent an outer side of the steering valve 70, and beneath a right hand valve actuating shaft 136 and having a right hand valve actuating handle 137 and a shaft locking handle 138. The valve actuating handles 133 and 137 are shown in raised positions which is the normal operating configuration with all four control valves open as will be described.

The shaft locking handle 138 is located at an outer end of a plunger 135 which is mounted for axial movement within a sleeve 132 integral with and extending perpendicularly from the handle 137. The plunger 135 has an inner end which is received within an aligned opening of a receiver 140 which extends upwardly from the valve assembly, as best seen in FIG. 4. A coil spring 139 encloses and acts on the plunger 135 to force the plunger inwardly so that the inner end thereof engages the opening in the receiver when the aligned therewith. To move the handle 137, the handle 138 is grasped and drawn outwardly of the apparatus, per an arrow 144, so as to disengage the plunger from the opening in the receiver and to permit rotational movement of the handle as will be described. The handles 133 and 134 on the opposite side of the valve assembly function similarly, and thus are not described. As the control valves 35, 36, 41 and 42 are essentially identical and the scavenge valves 38 and 44 are identical, the right hand control valve 42 and scavenge valve 44 only will be described with reference to FIG. 4.

Referring to FIGS. 2 and 3, the actuating shaft 136 is journalled for rotation about an actuating shaft axis 141 in right hand shaft journals 142 and 143. The actuating shaft 136 carries valve actuators for each valve, a first control valve actuator 145 being shown for the first control valve 41 in FIG. 3. The valve actuator 145 comprises an eccentrically-mounted disc cam 146 carried on the shaft and fitted within an opening 147 of an body portion 148 of the valve 41 as will be described. The eccentric disc cam 146 is secured on the shaft 136 so that a cam lobe of the cam is disposed upwardly. The actuating shaft 136 carries a second control valve actuator 150 for the second valve 42 which is generally similar to the first valve actuator 145 and thus will not be described. In addition, the second valve actuator also has a disc cam secured to the shaft 136 to be in phase with the cam 146 of the first valve, so that the first and second valves are always at the same phase with respect to each other, that is both control valves are open or both are closed. In FIG. 3, the disc cam 146 is shown in a normal uppermost position which indicates that the valve 42 is open, which is the normal operating condition of the apparatus.

Referring to FIG. 4, because the control valve 42 is essentially identical to the control valve 41, identical parts are designated with identical numerical references to facilitate description thereof. The control valve 42, shown open, has a control valve body 151 which is secured by bolts, not shown, passing through openings 153 into the main valve body 12 as will be described with respect to FIGS. 5–11. The body portion 148 is received within an upper cup 152 which is connected with a bolt 154 to an upper end of a valve poppet 156. The valve poppet has a poppet stem 157 and a truncated conical poppet head 158, which, when the valve closes, is adapted to seal against a valve seat 160 secured to the control valve body 151. Ratio of cross-sectional areas of the poppet stem 157 to the poppet head 158 is selected so that operations of the valve does not become unstable. The control valve body 151 has a poppet sleeve 162 extending upwardly from a valve chamber 165 communicating with the seat 160 and enclosing the poppet head 158. A spring cap member 167 has a clearance opening to receive the bolt 154 and is carried at an upper end of the valve poppet 156 and has a lower rim 168 fitted within the main body portion.

A relatively heavy compression coil spring, i.e. closing spring 171, extends between the lower rim 168 and an upper rim 173 of the upper cup 152 to apply a downwards force to the cap member 167. A relatively lighter compression coil spring, i.e. valve return spring 176, is fitted in an annular clearance between the poppet sleeve 162 and the spring cap member 167 so as to apply a separating force between the body and the cap member. The valve poppet 156 is raised and lowered by the disc cam 146 which provides a fixed stroke, the accuracy of which is dependent on manufacturing tolerances. When the eccentric disc cam 146 is at an uppermost position thereof reflecting that the control valve 42 is open as shown, rotation of the handle 137 through 90 degrees rotates the disc cam 146 so as to move the valve actuator downwardly. The rotation of the handle 137 is limited by stops at 90 degrees, but downward movement of the poppet head 158 is limited by the poppet head 158 contacting the seat 160. Depending on manufacturing tolerances, the poppet head may be fully seated slightly before, or slightly after, the 90 degree rotation is completed. Clearly, the closing spring 171 is somewhat redundant for gross movement of the valve for closing the valve, but provides a resilient valve poppet mounting to ensure complete valve closure to counter any upwards lost motion in valve movement due to the valve return spring 176. Thus, the resilient mounting of the valve poppet with respect to the valve actuating mechanism provides accommodation of poppet head travel which is necessary due to the fixed stroke of the valve actuator. It can be seen that the heavier closing spring 171 can therefore compensate for "over-travel" or "under-travel" of the valve poppet, ensuring that an adequate valve seal is obtained without damage to the valve. Thus, the closing spring 171 accommodates lost motion and manufacturing tolerances in the valve actuator mechanism.

Still referring to FIG. 4, the scavenge valve 44, which is shown closed, is similarly controlled through a scavenge valve actuator 185 which comprises an eccentric disc cam 187 mounted on the actuating shaft 136 similarly to the cam 146. The cam 187 rotates against a roller 189 which is journalled in a pair of journalling ears 191 mounted on an actuating cap 194. An actuating plunger 196 extends downwardly from the cap and is guided for axial movement within a complementary guide sleeve 198. A return spring 200 extends between the sleeve 198 and the cap 194 to apply an upwards force to the plunger, which, as will be described, tends to move the plunger to a raised position as shown to close the scavenge valve. The shaft 136 ensures that the scavenge valve 44 is always actuated simultaneously with the control valves 41 and 42, and the relative positions of the three cam discs on the shaft ensures that the scavenge valve 44 is always in a mode opposite to the mode of the control valves.

The plunger 196 has a lower end portion provided with a truncated conical portion which serves as a cam portion 202 and engages a pair of axially opposed, similar, first and second cam follower plungers mounted for axial movement within respective first and second follower passages 209 and 210 respectively. For simplicity, only the second follower passage 210 is shown containing a second cam follower plunger 205, the first cam follower plunger being omitted for clarity. The follower plunger 205 has a head portion which is a relatively snug fit within the follower passage 210, and a relieved shank portion 207 which provides clearance between the shank portion and the passage 210. The passage 210 has an annular valve seat 213 extending therearound, and contains a valve ball 212 which is urged against the valve seat 213 by a plunger spring 214. A receiver 215 is interposed between, and has faces which are complementary to, the ball 212 and the spring 214 to stabilize the spring and ensure correct application of spring force to the ball. The follower plunger 205 has a length such that the ball 212 is also urged against an outer end of the shank portion 207 of the plunger when the plunger 196 is retracted, i.e. raised as shown. Thus both the ball 212 and the follower plunger 205 are urged towards the cam portion 202 by the spring 214, the ball 212 simultaneously closing the passage 210. The first cam follower plunger (not shown) and a similar first valve ball, not shown, are mounted in the follower passage 209 and are urged in an opposite direction against an opposite side of the cam portion 202 to close the passage 209. The first and second follower passages 209 and 210 have the first and second scavenge ports 105 and 106 (of the valve 44) which are also seen in FIG. 1 in which the port 106 is shown controlled by an undesignated ball which corresponds to the valve ball 212 of FIG. 4.

Referring to FIG. 2, the ports 105 and 106 are shown at ends of parallel scavenge passages 217 and 218, shown in broken outline. The passages 217 and 218 extend inwardly from the ports 105 and 106 at follower passages 209 and 210 respectively to communicate with a scavenge manifold unit 228 (broken outline) as will be described with reference to FIGS. 5 through 11. The scavenge manifold unit 228 collects fluid and returns fluid to the sump 72, and thus is equivalent to the main scavenge conduit 83 of FIG. 1. When the plunger 196 is retracted as shown in FIG. 4, the cam follower plunger 205 partially closes an inner end of the follower passage 210 and the valve ball 212 rests against the seat 213, thus fully closing the follower passage 210 and the scavenge passage 218. Similarly, the first valve ball, not shown, in the passage 209 on the opposite side of the plunger 196, similarly closes the first follower passage 209 and the scavenge passage 217, so that both parts of the scavenge valve are closed.

Referring again to FIG. 4, rotation of the handle 133 from the normal raised position through 90 degrees results in downwards movement of the actuating plunger 196 which simultaneously moves both follower plungers outwardly to lift the respective valve balls off their respective seats so as to open ports 105 and 106 of the passages 217 and 218 simultaneously to permit flow of fluid therethrough relative to the manifold unit 228. The follower passage 210 has an outlet 219 which communicates with the control valve 42, and the follower passage 209 has an outlet 221 which communicates with the control valve 41. The main scavenge port 98 communicates with a lower portion of the sleeve 198 containing the cam portion 202 of the actuating plunger. The port 98 does not receive large volumes of fluid flow, but merely serves to drain any leakage of fluid which flows past the cam follower plungers inwardly towards the cam portion 202.

Thus, it can be seen that the left hand shaft 131, the disc cams, the valve actuators, associated handles 133 and 134 etc. serve as a left hand control device cooperating with the first and second left hand control valves 35 and 36 and the left hand scavenge valve 38 to actuate all said left hand valves simultaneously. In addition, the left hand control device maintains the first and second left hand control valves in identical modes, and maintains the left hand scavenge valve in a mode opposite to the first and second left hand control valves. Similarly, the right hand shaft 136 and associated structure serve as a similar right hand control device to operate all the right hand valves 41, 42 and 44 simultaneously and maintain a similar mode difference. It can be seen that the left hand and right hand control devices are operable independently of each other, and in normal operation both handles 133 and 137 extend upwardly as shown, and in an emergency operation, one handle is rotated as will be described.

It can be seen that the scavenge valve actuator, namely the plunger 196 and associated structure simultaneously control flow through the first and second ports of the scavenge passages 217 and 218, which, when the scavenge valve 44 is open from its normally closed position, communicate with the control valves 41 and 42 respectively.

Figure 8:
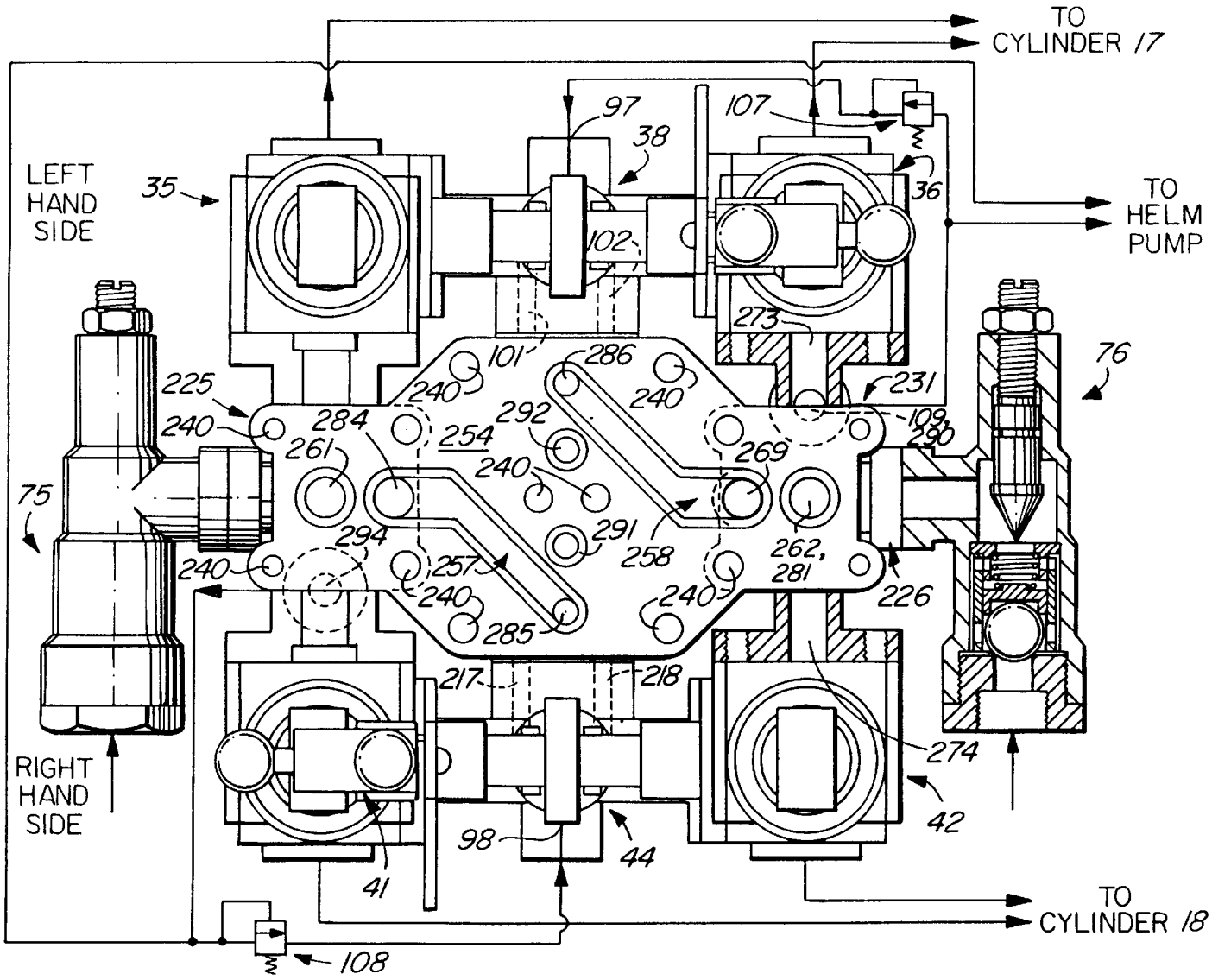
FIG. 8 is a simplified fragmented section as would be seen generally on line 8—8 of FIG. 5, showing a lower manifold plate and structure associated therewith, the pressure relief valves and conduits being shown schematically.

As seen in FIG. 3, the discharge port 109 is shown communicating through the pressure relief valve and conduit 108 with the port 98 of the scavenge valve 44. This connection, and a corresponding connection for the scavenge port 97 of the valve 107 is omitted from FIG. 2, and is also seen in FIGS. 8.

Figure 5:
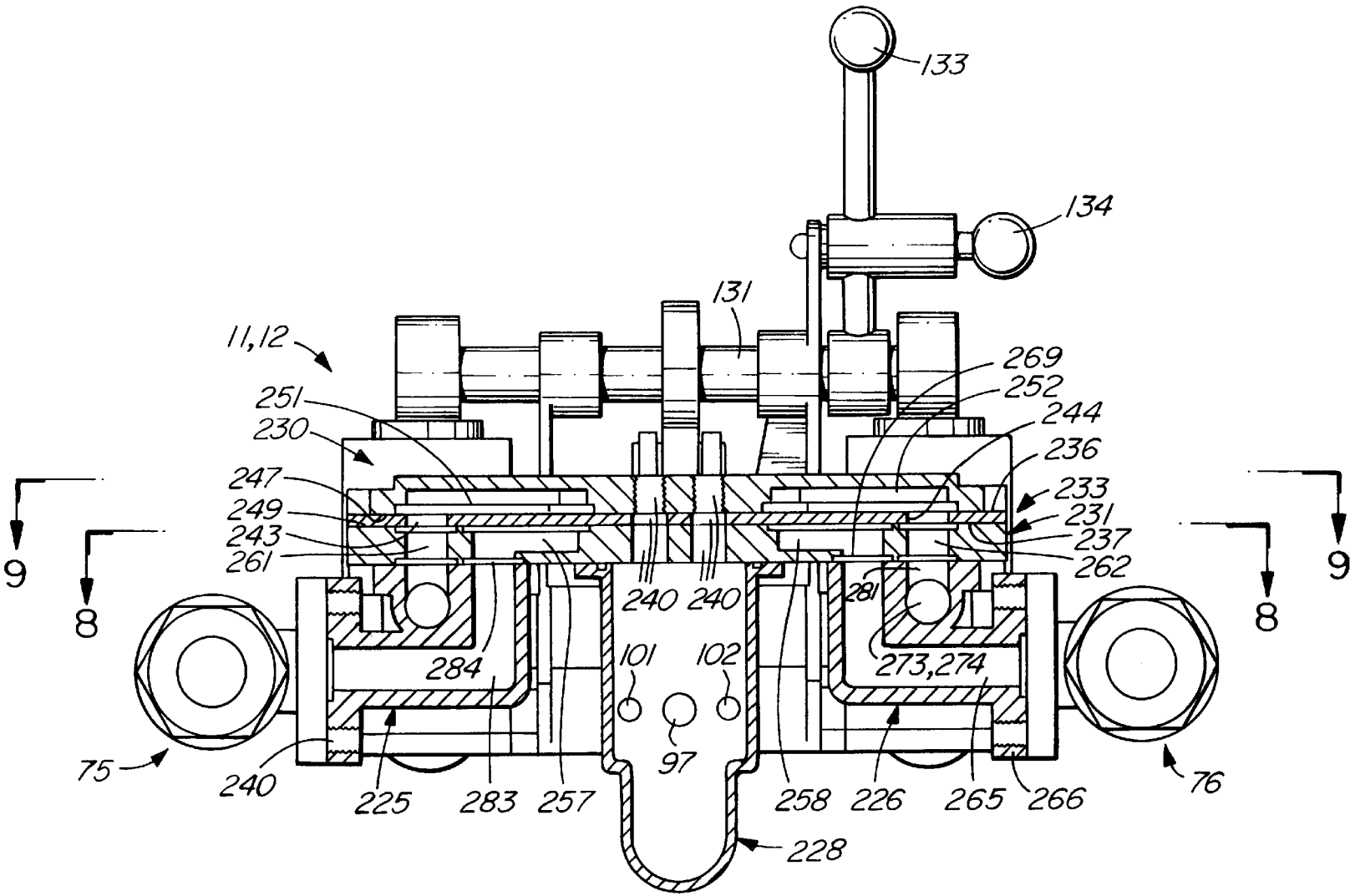
FIG. 5 is a simplified fragmented section generally as seen on line 5—5 of FIG. 2, with a directional steering valve removed for clarity.
Figure 6:
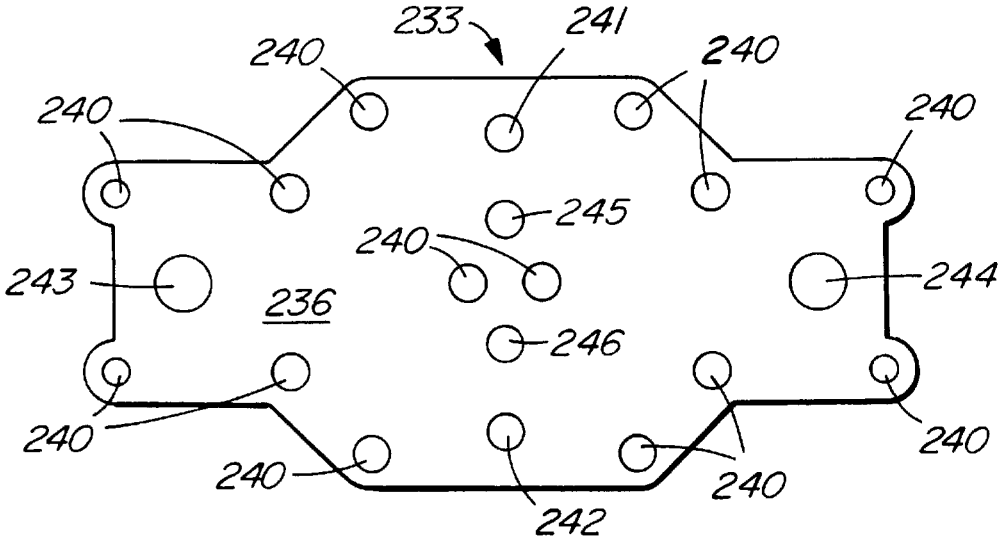
FIG. 6 is a top plan of a manifold separator plate of the apparatus.
Figure 7:
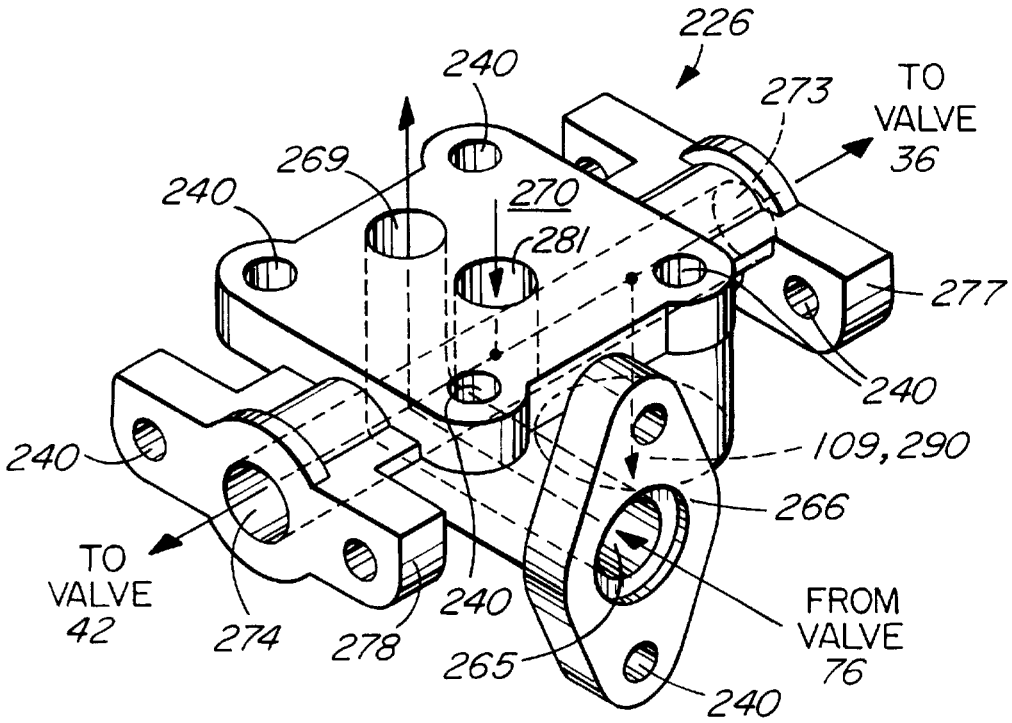
FIG. 7 is a simplified perspective of a fluid manifold unit for connecting components to the valve body, showing routing of conduits and connections.

FIGS. 5, 6 and 7

Referring to FIGS. 5 and 6, the valve body 12 includes a plurality of manifold components which provide conduits to transmit pressurized fluid from the check valves 75 and 76 to the control valves and scavenge valves which communicate with the cylinders 17 and 18 and the sump 72 (FIG. 1). The plurality of manifold components are preferably modular units which are releasibly interconnected to simplify manufacturing and servicing, and include primary and secondary input manifold units 225 and 226, the scavenge manifold unit 228 briefly referred to previously, upper and lower manifold plates 230 and 231 and a manifold separator plate 233. The input manifold units 225 and 226 are essentially identical to each other, are connected to a lower plate surface of the lower plate 231 and located on opposite sides of the axis 114 (FIG. 2) and the manifold unit 228 to cooperate directly with the primary and secondary steering check valves 75 and 76 respectively. The scavenge manifold unit 228 has the scavenge port 71 (FIGS. 3 and 4) and is fitted between the input manifold units and is also secured to the lower surface of the lower plate 231. The manifold unit 228 extends transversely across the valve body 12 and cooperates with the scavenge valves 38 and 44 to collect low pressure fluid for return to the sump as best seen in FIG. 1. The upper and lower manifold plates 230 and 231 sandwich the separator plate 233 therebetween and form a distribution unit which is fitted on top of the manifold units 225 and 226 and between the control valves 35 and 36 and the scavenge valve 38 on one side of the axis 113, and the control valves 41 and 42 and the scavenge valve 44 on the opposite side of the axis. The manifold units, the check valves 75 and 76, the scavenge valves 38 and 44, and the control valves 35, 36, 41 and 42 are releasibly connected together with threaded fasteners, not shown, which pass through aligned fastener openings in the manifold components, some fastener openings being designated 240.

The separator plate 233 can be relatively thin and serves to separate conduits in the upper and lower plates, and to provide selective communication between the conduits in the plates as required. The plate 233 has generally flat upper and lower surfaces 236 and 237 respectively in engagement with the upper and lower plates 230 and 231. As best seen in FIG. 6, the plate 233 has a plurality of access openings (apart from the fastener openings 240) the function of which will be described with reference to FIGS. 6 through 11. The plate 233 has two access openings, namely primary and secondary access openings 243 and 244 (also shown in FIG. 5), outer valve access openings 241 and 242 which receive pressurized fluid as required, and inner valve access openings 245 and 246 which return low pressure fluid to the sump 70 (FIG. 1). These access openings provide communication across the plate 233 between the upper and lower plates 230 and 231 to be described with reference to FIGS. 8 through 11.

The upper manifold plate 230 has a lower plate surface 247 which engages the upper surface 236 of the plate 233, and has a plurality of surface grooves therein which provide horizontal primary and secondary transfer conduits 251 and 252 respectively as will be described with reference to FIGS. 9, 10 and 11. Similarly, the lower manifold plate 231 has an upper plate surface 249 which cooperates with the lower surface 237 of the separator plate 233 and has a plurality of surface grooves therein which provide horizontal primary and secondary transfer conduits 257 and 258, and also vertical primary and secondary access conduits 261 and 262 respectively, as will be described with reference to FIGS. 8, 10 and 11. In FIG. 5 it can be seen that the opening 244 in the separator plate 233 provides communication between the secondary transfer conduit 252 in the upper plate 230 and the secondary access conduit 262 in the lower plate 231, which in turn communicates with conduits within the input manifold unit 226 as will be described with reference to FIG. 7. Similarly, the access opening 243 in the separator plate 233 communicates the primary transfer conduit 251 in the plate 230 with the primary access conduit 261 in the plate 231. Each access groove and access opening provided in the upper and lower surfaces 249 and 247 of the lower and upper plates respectively has a respective gasket groove extending therearound to receive a resilient gasket therein (the gaskets being omitted in FIG. 5) as will be described with reference to a typical gasket and associated grooves shown in FIG. 10.

Referring also to FIG. 7, the secondary input manifold unit 226 has an upper surface 270 which is secured against the lower plate surface of the lower plate 231 and has ports therein to provide communication with the openings in the lower surface of the lower plate as will be described. In addition, the manifold unit has four vertical fastener openings 240, a check valve flange 266, and left and right control valve flanges 277 and 278, the flanges having horizontal fastener openings 240. The secondary input manifold unit 226 has an L-shaped conduit 265 communicating with the check valve flange 266 to which is secured the secondary steering check valve 76 to communicate therewith, using threaded fasteners, not shown. The L-shaped conduit 265 passes inwardly and then upwardly to an upper port 269 in the upper surface 270 of the unit 226 to communicate with an undesignated access opening in the lower surface of the lower plate 231 which provides access to the secondary transfer conduit 258. The port 269 eventually communicates with the directional valve to discharge fluid therein as will be described.

The manifold unit 226 also has left and right control conduits 273 and 274 which are aligned with each other and pass through ports in the left hand and right hand control valve flanges 277 and 278 respectively to communicate with appropriate left and right hand control valves as will be described with reference to FIGS. 8 and 9. A connecting conduit 281 extends downwardly from the upper surface 270 of the manifold unit 226 to communicate with the control conduits 273 and 274, and communicates upwardly via the access conduit 262 in the lower plate 231 and the secondary access opening 242 in the separator plate 233 with the transfer conduit 252 in the upper plate 230 to receive fluid from the directional valves as will be described. A discharge conduit 290, shown schematically in FIG. 7, extends downwardly from the conduits 273 and 274 to the discharge port 109 to discharge fluid from the manifold unit 226. This port 109 was first described in FIG. 3, and is best seen in FIG. 10. The discharge conduit 290 and associated port 109 are also used in conjunction with the emergency helm pump, as described with reference to FIG. 1.

Referring again to FIG. 5, similarly to the surface grooves and access openings in the lower and upper surfaces of the upper and lower plates respectively which engage the separator plate 233, the openings in a lower surface of the lower plate 231 are provided with gasket grooves and gaskets to seal against the upper surface 270 of the unit 226, and an equivalent surface of the unit 225. Also, a peripheral edge of the scavenge manifold unit 228 is similarly provided with a gasket groove and complementary gasket to seal against the lower surface of the lower plate 231.

FIGS. 5 through 11

Figure 11:
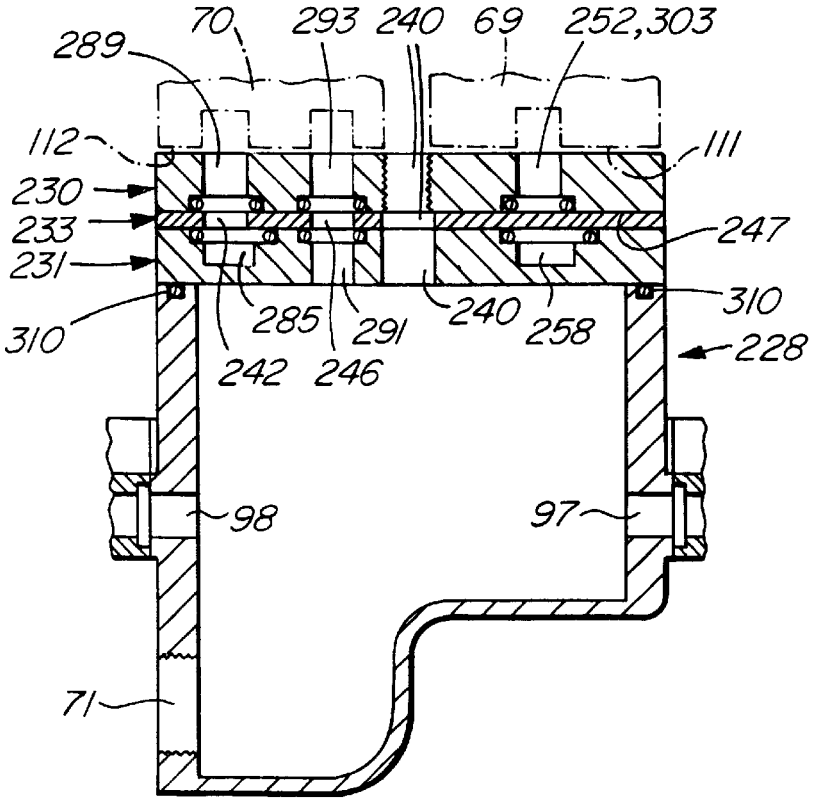
FIG. 11 is a simplified fragmented section on line 11—11 of FIG. 9.

Referring to FIGS. 5, 8 and 11, the upper surface 249 of the lower plate 231 has the transfer conduits 257 and 258 which resemble oblique L-shapes in FIG. 8. The conduit 258 has an outer end which communicates through an undesignated access opening in the lower plate 231 with the aligned upper port 269 of the L-shaped conduit 265 of the secondary manifold unit 226 (see FIG. 5). The transfer conduit 257 has a similar outer end which communicates with a corresponding aligned upper port 284 of an L-shaped conduit 283 of the primary manifold unit 225.

As seen in FIG. 8, the transfer conduits 257 and 258 in the lower plate 231 have inner access conduits 285 and 286 respectively which communicate upwardly with the aligned access openings 242 and 241 respectively in the separator plate 233 (FIG. 6) as will be described. As also seen in FIG. 11, the access conduit 285 in the lower plate 231 communicates upwardly through the aligned outer access opening 242 in the separator plate 233 and with an aligned access conduit 289 in the upper plate 230. The access conduit 289 in turn communicates with the secondary directional valve 70 (shown in broken outline) which, with the directional valve 69 (shown in broken outline) is mounted in the plate 230. The conduit 286 communicates similarly with the directional valve 69. The lower manifold plate 231 also has access conduits 291 and 292 (FIG. 8) which communicate upwardly with the inner valve access openings 246 and 245 respectively (FIG. 6) of the separator plate 233, and downwardly with the scavenge manifold. The discharge conduit 290 from the input manifold unit 226 communicates with the relief valve and conduit 107, the scavenge port 97 and the helm pump as needed. A similar discharge conduit 294 of the input manifold unit 225 similarly communicates with the relief valve and conduit 108, the scavenge port 98 and the helm pump as needed.

In FIG. 11, the manifold unit 227 is shown communicating upwardly through the conduit 291 in the lower plate 231, through the inner valve access opening 246 in the separator plate 233, through an aligned access conduit 293 in the upper plate 231 and eventually with the valve 70. Referring to FIGS. 5, 9 and 11, the grooves in the lower surface 247 of the upper plate 230 provide the primary and secondary transfer conduits 251 and 252 which, in FIG. 9, are shown in broken outline and are generally T-shaped. The conduits 251 and 252 are mirror images of each other and have outer access conduits 295 and 296 cooperating through the access openings 243 and 244 in the plate 233 with the primary access conduits 261 and 262 respectively in the lower plate 231 (FIG. 6 and 8). The conduits 261 and 262 communicate through the manifold units 225 and 226 with associated pairs of the control valves 35 and 41, and the control valves 36 and 42 respectively. The primary transfer conduit 251 has left and right inner portions which have inner access conduits 299 and 300 respectively which extend upwardly to communicate with ports of the directional valves 69 and 70 respectively. Similarly, the secondary transfer conduit 252 has left and right inner portions which have inner access conduits 303 and 304 respectively which extend upwardly to communicate with ports of the directional valves 69 and 70 respectively also.

Figure 9:
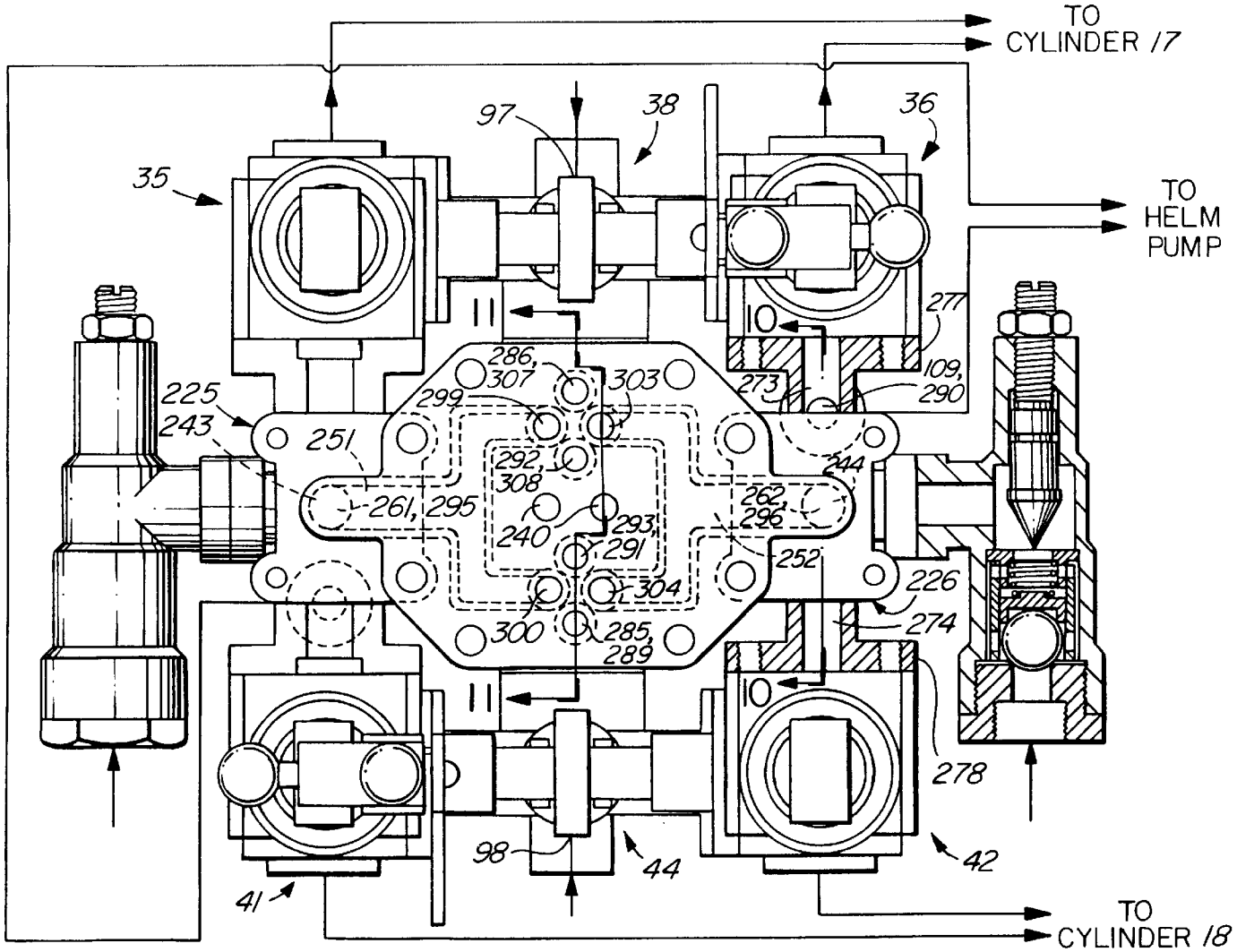
FIG. 9 is a simplified fragmented section generally as seen on line 9—9 of FIG. 5, showing an upper manifold plate and structure associated therewith, the pressure relief valves and conduits being omitted for clarity.

As seen in FIG. 9, the plane 11—11 of the section of FIG. 11 is not symmetrical (in FIG. 9), and FIG. 11 shows that the transfer conduit 258 in the lower plate 231 does not communicate immediately upwardly as there is no aligned opening in the separator plate 233. However, an access conduit 303 at the end of the transfer conduit 252 in the upper plate 230 is shown communicating with a aligned port of the directional valve 69. In FIG. 8, access conduits 291 and 292 in the lower plate 231 are aligned with the access openings 246 and 245 respectively in the separator plate 233 (FIG. 6), and with the access conduits 291 and 292 respectively in the upper plate 230 which communicate with the directional valves 69 and 70. similarly, inner access conduits 285 and 286 in the lower plate 231 communicate with the aligned access openings 242 and 241 respectively in the separator plate 233 and with access conduits 289 and 307 in the upper plate 230 to communicate with the directional valve 69 and 70.

Thus, in summary, the four access conduits 299, 303, 307 and 308 in the flat upper surface of the upper plate 230 communicate with four aligned undesignated ports in a flat lower surface of the directional valve 69. In addition the four access conduits 289, 293, 300 and 304 in the upper surface of the upper plate 230 similarly communicate with four aligned undesignated ports in the directional valve 70.

Figure 10:
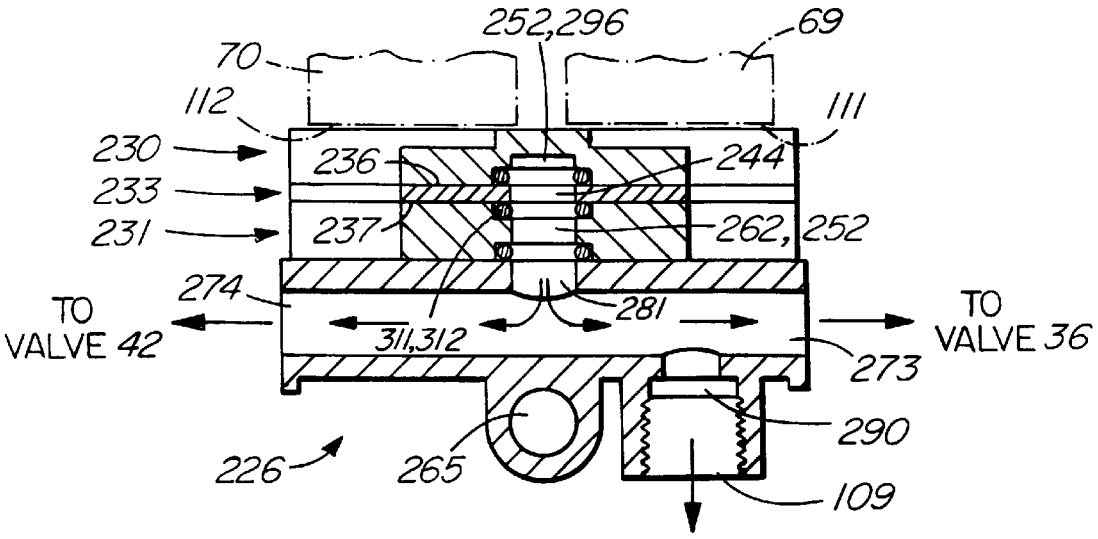
FIG. 10 is a simplified fragmented section on line 10—10 of FIG. 9.

Referring specifically to FIG. 10, each gasket and associated gasket groove function generally similarly, and thus only one typical gasket and gasket groove will be described in detail as follows. A gasket groove 311 and associated gasket 312 extend around an upper end of the secondary access conduit 262 in the upper surface of the lower plate 231. The gasket is made of a resilient elastomeric material and has a relaxed dimension greater than the depth of the respective gasket groove 311 so that, when the plates 230, 231 and 233 are clamped together with fasteners engaging the appropriate threaded fastener openings, the gasket is compressed between the walls of the gasket groove 311 and the lower surface 237 of the plate 233 to provide a fluid tight seal. It can be seen that a lower end of the conduit 262 has a similar gasket and gasket groove cooperating with an upper surface of the input manifold unit 226. A similar gasket and groove extend around the conduit 252 in the upper plate 230. Similarly, gaskets fitted in complementary gasket grooves extend around the ports in the directional valve 69 and 70, and around all conduits and grooves which are held against an adjacent surface, thus essentially preventing fluid leakage between the valves, the manifold units and related inter-connected structure. By providing the modular units as shown, fitted with sealed grooves and access openings, manufacturing, assembly and the servicing of the valve apparatus 11 is simplified.

Still referring to FIG. 10, the discharge port 109 is shown communicating upwardly with the left and right control conduits 273 and 274 which pass across the unit 226, thus clarifying the schematic representation of this connection shown in FIG. 7. In addition, the location of a horizontal portion of the L-shaped conduit 265 is seen more clearly than in the view in FIG. 7.

Referring to FIGS. 8 and 11, the scavenge manifold unit 228 is shown fitted to the lower surface of the lower plate 231 with peripheral gasket 310 engaging the lower surface to seal thereagainst. The main scavenge ports 97 and 98 are aligned with each other and located within walls of the scavenge manifold unit 228 and located beneath the directional valve 69 and 70 as shown. As seen in FIG. 2, the scavenge ports 97 and 98 receive fluid from the pressure relief valves 107 and 108 respectively (see FIG. 1) when the rudder encounters an obstruction generating excess pressure within the system.

Operation

Referring to FIG. 1, as stated previously, the primary and secondary directional valves 69 and 70 are disposed in parallel and receive pressurized fluid from respective primary and secondary steering pumps 73 and 74 through respective primary and secondary check valves 75 and 76. Thus, when the hydraulic circuit 10 operates in a normal operational mode, one or both of the primary and secondary directional steering valves 69 and 70 can be activated in response to steering demands from the helm. In any event, in the normal mode, both cylinders 17 and 18 are activated simultaneously to swing the rudder 30.

In the description following, for convenience of description, only the secondary steering pump 74 is operating, and secondary directional steering valve 70 is shifted to the right in FIG. 1 to feed fluid into the second main conduit 88 from which fluid is distributed to the remainder of the system. In this single pump/single valve mode, the pump 73 is not operating, and the primary directional steering valve 69 is assumed to be centered and locked so as to eliminate communication between all ports associated therewith. Also, the check valve 75 maintains system pressure to prevent any possible pressure loss through the closed valve 69. The operation will be described in sections, referring both to the overall schematic of FIG. 1, and, at appropriate intervals, to specific general assemblies and detailed drawings of the remaining Figures.

In the normal operation, the valve actuating handles 133 and 137 are disposed vertically as shown in FIG. 3, in which position the control valves 35, 36, 41 and 42 are open, and the scavenge valves 38 and 44 are closed. Referring to FIG. 2, flow from the pump 74 passes into the check valve 76 and past the ball 120 which is lifted off its seat 121 by fluid pressure to compress the spring 122. Flow is metered by the metering needle 127 as the flow is discharged from the valve 76 in direction of the arrow 129 and into the secondary input manifold unit 226.

Referring to FIG. 7, the fluid passes first into the L-shaped conduit 265 and upwardly through the upper port 269. As seen in FIGS. 5 and 8, pressurized fluid leaving the upper port 269 of the unit 226 passes into the secondary transfer conduit 258 and is transferred to the inner access conduit 286 where is passes upwardly through the access opening 241 in the separator plate 233 and the access conduit 307 in the upper manifold plate 230 and upwardly into the directional valve 70.

Referring to FIGS. 9 and 10, fluid discharged from the directional valve 70 leaves the directional valve downwardly through the access conduit 303 in the upper manifold plate 230 to be received in the transfer conduit 252, which transfers the fluid to the access conduit 296 in the plate 230. The fluid passes downwardly through the access conduit 296 in the plate 230, through the access opening 244 in the separator plate 233 and downwardly into the access conduit 262 in the lower plate manifold 231 and into the manifold unit 226 (FIG. 7) via the connecting conduit 281.

Flow from the conduit 281 is divided to leave the input manifold unit 226 to flow to the open control valves 36 and 42 by passing through the control conduits 273 and 274, which are thus equivalent to the conduits 88, 92 and 96 respectively of FIG. 1. Fluid cannot flow along the scavenge conduits 83, 99, 100, 103 and 104 of FIG. 1 because of the closed scavenge valves, i.e. the actuating plunger 196 (FIG. 4) is in the retracted or raised position thereof. The control valves 36 and 42 are open to permit flow of pressurized fluid from the conduit 88 (FIG. 1). Pressurized fluid from the valves 36 and 42 is discharged through the body ports 47 and 56 respectively into the ports 25 and 28 of the cylinders 17 and 18 respectively. The cylinder 17 thus extends and simultaneously the cylinder 18 retracts, thus swinging the rudder anti-clockwise per the undesignated arrow. Fluid displaced by the cylinders discharges from the cylinders 17 and 18 through the ports 26 and 27 respectively to flow to the body ports 48 and 55 respectively. The discharged fluid then passes through the control valves 35 and 41 into the conduit 91 and 95 respectively, into the conduit 87, and then to the directional valve 70 to return to sump.

For equivalent normal operation in an opposite direction, the rudder swings in a direction opposite to the arrow by interchanging the ports of the valve 70 following shifting the spool thereof in the opposite direction, i.e. to the left in FIG. 1.

In an emergency, the appropriate valve actuating handle 133 or 137 (FIGS. 2–5) is actuated, i.e. one lever is swung through 90 degrees so as to switch the scavenge valve and two control valves controlled by that particular lever to opposite conditions. This contrasts with the prior art where many valves would require actuating in a specific sequence with a great likelihood of actuating the wrong valve, or actuating the valves in the wrong sequence. In a first emergency example to be described it is assumed that the circuit of the right hand cylinder 18 (FIG. 1) becomes inoperative, for example due to leakage of the piston seal within the cylinder 18, leakage in conduits 59 or 60 or failure of the control valve 41 and/or 42. Thus the cylinder 18 must be isolated and this is achieved by actuating the right hand handle 137 which closes both the right hand control valves 41 and 42 while simultaneously opening the scavenge valve 44. In this emergency example, flow in the control conduits 95 and 96 through the valves 41 and 42 is now prevented, but flow through the scavenge valve 44 is now possible to enable the cylinder 18 to passively respond to movement of the rudder as will be described.

Referring again to FIG. 1, in the above described emergency example, it is assumed that the cylinder 17 is to be extended positively (i.e. under power from pressurized fluid) as previously described, which results in passive retraction of the cylinder 18. This passive retraction results in displacement of fluid from the port 27 of the cylinder 18 along the conduit 59 as before, while drawing fluid or air from the sump into the port 28 of the cylinder 18 along the conduit 60. As the valves 41 and 42 are closed, fluid flows from the conduit 59 through the port 55 and into the right scavenge conduit 103 to the scavenge valve 44 which is now open. Simultaneously, the fluid or air drawn into the cylinder 18 through the conduit 60 and the port 56 is supplied from the scavenge valve 44 through the scavenge conduit 104 from the sump, or air drawn from a break in the conduit. Thus, in effect, fluid volume displaced from one side of the piston in the cylinder 18 (i.e. from a head chamber without the piston rod) is transferred to the opposite side of the piston (i.e. to a rod chamber with the piston rod) through the scavenge valve 44. Clearly, fluid displacement relative the rod chamber of the cylinder 18 is of less volume than fluid displacement relative to the head chamber of the cylinder due to volume displacement to the piston rod itself. In a reverse situation, if the inactive cylinder extends, as opposed to retracts as described, any difference in fluid volume due to the piston rod is made up by additional fluid from the sump 72 or additional air, thus overcoming potential hydraulic lock problems found in the prior art.

Referring to FIG. 4, when the valve actuating handle 137 is fully actuated in the emergency, the shaft 136 rotates through 90 degrees and the eccentric disc cam 187 of the scavenge valve 44 rotates similarly so as to displace the actuating plunger 196 downwardly. Downwards movement of the plunger 196 simultaneously moves the cam follower plunger 205 to the right, and the opposite cam follower plunger, (not shown) to the left. This simultaneous outwards movement of the cam follower plungers opens both the valves controlling fluid flow through the follower passages 209 and 210. For example, the valve ball 212 closing the valve seat 213 of the follower passage 210 is lifted off its seat by this movement of the plungers 196 and 205. Thus, fluid displaced from the head chamber by the piston of the cylinder 18 (FIG. 1) passes through body port 55 (FIG. 1) and enters the appropriate follower passages of the scavenge valve. The fluid passes from the follower passage into the scavenge port 98 and into the scavenge manifold unit 228 to the sump. Fluid or air from the sump passes into the appropriate follower passage on the opposite side of the scavenge valve so as to enter the expanding rod chamber of the cylinder 18 on the opposite side of the piston. Clearly, volume differences in fluid (or air and fluid) are accommodated by the scavenge port 98 communicating with the scavenge manifold unit 228, as seen in FIG. 5. Any excess fluid in the manifold unit 228 (i.e. the conduit 83) passes to the sump 72 (see FIG. 1).

Referring again to FIG. 4, when the scavenge valve 44 opens, the control valves 41 and 42 simultaneously close as previously described. Thus, rotation of the shaft 136 rotates both control valve actuators, e.g. the first valve actuator 145, which forces the valve poppet 156 downwardly so that the poppet head 158 approaches the valve seat 160. The closing spring 171 completes the downward movement or accommodates an excess downward movement of the poppet head due to the cam disc as previously described to ensure that the poppet head 158 contacts the valve seat properly so as to close the control valve 42.

The description above describes routine operation of the system during normal operation, and during the first example of emergency with one inoperative cylinder circuit using only the secondary directional valve 70. If both directional valves were in operation, volume of fluid fed by both pumps 73 and 74 would increase and thus speed of reaction of the steering cylinders would be faster. Clearly, a generally similar operation would result if the valve 70 and/or the pump 74 were deactivated, and the valve 69 and pump 73 provided pressurized fluid by themselves. In a second emergency example, if both pumps 73 and 74 became inoperative, or if both directional valves 69 and 70 became inoperative, the conventional emergency helm pump, not shown, would be operated manually. Rotating the helm pump in the appropriate direction supplies manually pressurized fluid through one of emergency ports 77 or 78 to feed into the appropriate conduits 87 or 88, and to scavenge return fluid through the remaining emergency port. Clearly, in this second emergency example the helm pump serves as a substitute hydraulic signal apparatus which is manually actuated by the operator to generate fluid signals which are received by the valve apparatus 11. Both the direction valves 69 and 70 normally would be centered in the closed position, but such valves usually permit a slow leak and would not, by themselves, maintain system pressure. Thus, the check valves 75 and 76 act as the main seal to prevent loss of fluid pressure and permit pressurizing of the system manually using the helm pump.

In a third emergency example, it is assumed that the rudder has unintentionally contacted an obstruction and is forced so as to generate excess pressure in the system. In this case one or both of the pressure relief valves 107 and/or 108 will open to pass fluid from the side of the piston under excess pressure to dump fluid into the scavenge conduit 83 and back into the sump, and in many cases, this can prevent damage to the system.

Alternatives

In the preferred embodiment, the main valve body 12 comprises a plurality of manifold units which are releasibly interconnected together to facilitate manufacturing and servicing, etc. In addition, the main valve body provides a mounting for the four control valves and two scavenge valves and thus many individual components are fitted together to provide a final unitary assembly. It is added that many of individual components are relatively simple to manufacture by die casting, and thus this can reduce the cost of manufacturing and servicing. It is anticipated that the number of modular components might be reduced, but this might increase the complexity of the components. Preferably, for simplicity, the plurality of manifold units should include at least one manifold plate having a plate surface with at least one surface groove therein. The surface groove has a gasket groove extending therearound, and a resilient gasket is received within the groove. The valve body further comprises a separator plate having a surface held against the plate surface of the manifold plate so that the gasket is compressed within the gasket groove so as to seal against the surface of the separator plate to define a conduit between the manifold plate and the separator plate. Clearly, other arrangements could be provided to simplify manufacturing. In the preferred embodiment as illustrated the separator plate is disposed between upper and lower manifold plates, and has at least one access opening therein to permit communication between the upper and lower manifold plates.

Also, the control devices for the control valves and scavenge valves comprise a movable valve actuating shaft having valve actuating devices thereon for actuating the control valves and the scavenge valves. In the preferred embodiment, the valve shafts are rotatable and the valve actuating devices comprise cams which are rotatable with the shaft. Clearly, alternative control devices could be substituted for rotatable cam shaft, for example sliding shafts with appropriate cams or other valve actuating devices thereon which could actuate the valves simultaneously.

What is claimed is:

1. A hydraulic valve apparatus for controlling pressurized fluid flow from at least a first fluid pump for distribution to left hand and right hand hydraulic actuators in response to signals from an operator, each hydraulic actuator having first and second actuator ports, the valve apparatus comprising:

(a) a main valve body having: first and second main ports communicating selectively as required with a fluid supply or a fluid return; a main scavenge port to return fluid to a sump; first and second left hand body ports to communicate with the first and second actuator ports of the left hand hydraulic actuator respectively; and first and second right hand body ports to communicate with the first and second actuator ports of the right hand actuator respectively, (b) left hand and right hand scavenge valves communicating with the main scavenge port, the left hand scavenge valve also communicating with the first and second left hand body ports, and the right hand scavenge valve also communicating with the first and second right hand body ports, (c) first and second left hand control valves communicating with the fluid supply and fluid return selectively as required, and also with the left hand body ports, (d) first and second right hand control valves communicating with the fluid supply and fluid return selectively as required, and also with the right hand body ports, (e) a left hand control device cooperating with the first and second left hand control valves and the left hand scavenge valve to actuate all said left hand valves simultaneously, and (f) a right hand control device cooperating with the first and second right hand control valves and the right hand scavenge valve to actuate all said right hand valves simultaneously.

2. An apparatus as claimed in claim 1, in which:

(a) the left hand and right hand control devices are operable independently of each other, (b) the left hand control device maintains the first and second left hand control valves in identical modes, and (c) the right hand control device maintains the first and second right hand control valves in identical modes.

3. An apparatus as claimed in claim 2, in which:

(a) the left hand control device maintains the left hand scavenge valve in a mode opposite to the first and second left hand control valves, and (b) the right hand control device maintains the right hand scavenge valve in a mode opposite to the first and second right hand control valves.

4. An apparatus as claimed in claim 1, in which:

(a) the left hand scavenge valve has a scavenge valve body having first and second ports communicating with the first and second actuator ports of the left hand actuator, and a main port communicating with the main scavenge conduit of the valve body, and (b) the right hand scavenge valve has a scavenge valve body having first and second ports communicating with the first and second actuator ports of the right hand actuator, and a main port communicating with the main scavenge conduit of the valve body.

5. An apparatus as claimed in claim 4, in which:

(a) the left hand scavenge valve actuator simultaneously controls flow through the first and second ports of the left hand scavenge valve, and (b) the right hand scavenge valve actuator simultaneously controls flow through the first and second ports of the right hand scavenge valve.

6. An apparatus as claimed in claim 1, further comprising:

(a) a primary directional valve selectively communicating with the first and second main ports as required, the directional valve being adapted to interchange connections between the pump and sump, and the first and second main ports.

7. An apparatus as claimed in claim 6, in which:

(a) the primary directional valve further includes a centre closed position which eliminates communication between all ports.

8. An apparatus as claimed in claim 7 further comprising:

(a) a secondary directional valve selectively communicating with the first and second main ports as required similarly to and in parallel with the primary directional valve, the directional valves having different nominal flow capacities and being adapted to be actuated separately or concurrently.

9. An apparatus as claimed in claim 1, in which the main valve body further includes:

(a) first and second left hand control conduits communicating the first and second left hand control valves with the first and second main ports respectively, and (b) first and second right hand control conduits communicating the first and second right hand control valves with the first and second main ports respectively.

10. An apparatus as claimed in claim 1, in which the main valve body further includes:

(a) first and second left hand scavenge conduits communicating the first and second left hand body ports respectively with the left hand scavenge valve, and (b) first and second right hand scavenge conduits communicating the first and second right hand body ports respectively with the right hand scavenge valve.

11. An apparatus as claimed in claim 1, in which:

(a) the left hand scavenge valve is connected in parallel with the first and second left hand control valves, and (b) the right hand scavenge valve is connected in parallel with the first and second right hand control valves.

12. An apparatus as claimed in claim 1, in which:

(a) the left hand control device comprises a movable left hand valve actuating shaft having valve actuating devices thereon for actuating the first left hand control valve, the second left hand control valve and the left hand scavenge valve, and (b) the right hand control device comprises a movable right hand valve actuating shaft having valve actuating devices thereon for actuating the first right hand control valve, the second right hand valve and the right hand scavenge valve.

13. An apparatus as claimed in claim 12, in which:

(a) the left hand and right hand valve actuating shafts are rotatable shafts, and (b) the valve actuating devices comprise left hand and right hand cams mounted on the left hand and right hand valve actuating shafts respectively for rotation therewith.

14. An apparatus as claimed in claim 1, in which:

(a) the first left hand control valve, the second left hand control valve and the left hand scavenge valve are located on one portion of the main valve body, and (b) the first right hand control valve, the second right hand control valve and the right hand scavenge valve are located on an opposite portion of the main valve body.

15. An apparatus as claimed in claim 1, in which:

(a) the main valve body further comprises first and second emergency ports communicating the first and second main ports with a hydraulic signal apparatus which is manually controlled by the operator, so as to receive fluid signals from the signal apparatus when normal pressurized fluid flow is unavailable.

16. An apparatus as claimed in claim 1 in which:

(a) the two scavenge valves are 2-way, normally-closed valves, each scavenge valve having first and second ports which are opened and closed simultaneously, and an open common port, and (b) the four control valves are 2-way, normally-open valves.

17. An apparatus as claimed in claim 1, in which the main valve body comprises: (a) a plurality of manifold units which includes at least one manifold plate having a plate surface with at least one surface groove therein, the said surface groove having a gasket groove extending therearound, and a resilient gasket is received within the groove, and (b) a separator plate having a surface held against the plate surface of the manifold plate so that the gasket is compressed within the gasket groove so as to seal against the surface of the separator plate to define a conduit between the manifold plate and the separator plate.

18. An apparatus as claimed in claim 17, in which:

(a) the said manifold plate is an upper manifold plate, and the plurality of manifold units also comprises a lower manifold plate having a respective plate surface with at least one surface groove therein, the surface groove of the lower manifold plate having a gasket groove extending therearound, with a resilient gasket being received within the groove, the surface grooves in the upper and lower manifold plates having portions generally adjacent each other, and (b) the separator plate being disposed between the manifold plates and having an access opening therein, the access opening being aligned with the said adjacent portions of the surface grooves within the upper and lower manifold plates to permit communication therebetween, the resilient gasket also passing around the opening in the separator plate to prevent leakage of fluid there through.

19. An apparatus as claimed in claim 1, in which each control valve comprises:

(a) a control valve body having an input conduit with the valve seat extending therearound, a valve actuating member and a valve member movable by the actuating member against the valve seat to close the input conduit, the valve member being resiliently mounted to engage the valve seat before the actuating member has completed a closing movement, so as to ensure closure of the valve seat, resiliency of mounting the valve member being sufficient to permit the valve member to be lifted clear of f the seat should excessive pressure be generated across the valve seat.

20. An apparatus as claimed in claim 1, in which each scavenge valve comprises:

(a) a scavenge valve body having an input port, and a pair of scavenge ports, the scavenge ports being normally closed but being openable to permit communication therebetween to permit flow of fluid in either direction with respect to the scavenge valve.

* * * * *